United States Patent [19]

Cookfair et al.

[11] 3,950,240

[45] Apr. 13, 1976

[54] ANODE FOR ELECTROLYTIC PROCESSES

[75] Inventors: Arthur S. Cookfair, Tonawanda; Donald E. Stephens; Tilak V. Bommaraju, both of Grand Island, all of N.Y.

[73] Assignee: Hooker Chemicals & Plastics Corporation, Niagara Falls, N.Y.

[22] Filed: May 5, 1975

[21] Appl. No.: 574,477

[52] U.S. Cl. ..... 204/290 F; 427/126

[51] Int. Cl.[2]... C25B 1/26; C25B 1/34; C25B 11/10

[58] Field of Search..... 204/290 F

[56] References Cited

UNITED STATES PATENTS

| | | | |
|---|---|---|---|
| 2,719,797 | 10/1958 | Rosenblatt | 204/290 F X |
| 3,701,724 | 10/1972 | Entwisle et al. | 204/290 F |
| 3,763,002 | 10/1973 | Skomoroski et al. | 204/37 |
| 3,773,555 | 11/1973 | Cotton et al. | 427/123 |
| 3,846,273 | 11/1974 | Bianchi et al. | 204/290 F |
| 3,853,739 | 12/1974 | Kolb et al. | 204/290 F |
| 3,875,043 | 4/1975 | Franks et al. | 204/290 F |

*Primary Examiner*—F. C. Edmundson

*Attorney, Agent, or Firm*—Peter F. Casella; Herbert W. Mylius

[57] ABSTRACT

An electrode useful as an anode for the electrolysis of aqueous solutions of ionizable chemical compounds, and especially the electrolysis of brines comprises an electroconductive substrate, such as a valve metal having a coating thereon of electroconductive tin oxide containing about 0.1 to about 15 mole percent of niobium based on the moles of tin. An additional electrocatalytic phase may be present as a minor component of the tin oxide coating and/or as a coating thereon.

17 Claims, No Drawings

ANODE FOR ELECTROLYTIC PROCESSES

BACKGROUND OF THE INVENTION

The present invention relates to improved electrodes particularly adapted for use as anodes in electrochemical process involving the electrolysis of brines.

A variety of materials have been tested and used as chlorine anodes in electrolytic cells. In the past, the material most commonly used for this purpose has been graphite. However, the problems associated with the use of graphite anodes are several. The chlorine overvoltage of graphite is relatively high, in comparison for example with the noble metals. Furthermore, in the corrosive media of an electrochemical cell graphite wears readily, resulting in substantial loss of graphite and the ultimate expense of replacement as well as continued maintenance problems resulting from the need for frequent adjustment of spacing between the anode and cathode as the graphite wears away. The use of noble metals and noble metal oxides as anode materials provides substantial advantages over the use of graphite. The electrical conductivity of the noble metals is substantially higher and the chlorine overvoltage substantially lower than that of graphite. In addition, the dimensional stability of the noble metals and noble metal oxides represents a substantial improvement over graphite. However, the use of noble metals as a major material of construction in anodes results in an economic disadvantage due to the excessively high cost of such materials.

Considerable effort has been expended in recent years in attempts to develop improved anode materials and structures utilizing the advantages of noble metals or noble metal oxides, while minimizing the amount of noble metals or noble metal oxides employed. A great amount of effort has been directed to the development of anodes having a high operative surface area of noble metal or noble metal oxide in comparison with the total quantity of the material employed. This may be done, for example, by employing the noble metal as a thin film or coating over an electrically conductive substrate. However, when it is attempted to minimize the aforementioned economic disadvantage of the noble metals by applying them in the form of very thin films over a metal substrate, it has been found that such very thin films are often porous. The result is an exposure of the substrate to the anode environment, through the pores in the outer layer. In addition, in normal use in an electrolytic cell, a small amount of wear, spalling or flaking off of portions of the noble metal or noble metal oxide is likely to occur, resulting in further exposure of the substrate. Many materials, otherwise suitable for use as a substrate are susceptible to chemical attack and rapid deterioration upon exposure to the anode environment. In an attempt to assure minimum deterioration of the substrate under such circumstances, anode manufacturers commonly utilize a valve metal such as titanium as the substrate material. Upon exposure to the anodic environment, titanium, as well as other valve metals, will form a surface layer of oxide which serves to protect the substrate from further chemical attack. The oxide thus formed, however, is not conductive and as a result the operative surface area of the anode is decreased.

In attempts to avoid the use of the expensive noble metals various other anode materials have been proposed for use as coatings over valve metal substrates. In U.S. Pat. No. 3,627,669, it is disclosed that mixtures of tin dioxide and antimony oxide can be formed as adherent coatings on a valve metal substrate to form an anode useful in electrochemical processes. In the electrolytic production of chlorine, alkali metal hydroxides, alkali metal chlorates and the like, anodes of this type provide the advantage of economy in the elimination of the use of expensive noble metals or noble metal oxides. In addition the tin oxide coating provides an effective protection for the substrate. However, the tin oxide compositions, although useful as anode materials and as a protective coating to prevent passivation of the valve metal substrate, nevertheless exhibit a chlorine overvoltage that is substantially higher than that of the noble metals or noble metal oxides. It has also been disclosed that noble metal oxides may be incorporated in coatings of a non-noble metal oxide. Thus, for example in U.S. Pat. Nos. 3,701,724 and 3,672,990, it is disclosed that anodes may be prepared which consist, for example of a valve metal substrate having a coating thereon which contains a mixture of a noble metal oxide such as ruthenium oxide, and a non-noble metal oxide, such as an oxide of tin, antimony, germanium, or silicon. Such anodes provide the electrocatalytic properties associated with the noble metal oxides while lessening the proportion of noble metal required. However, it has been found that when substantially lower amounts of the noble metal oxide are employed, for example, less than about 20 percent of the coating, the chlorine overvoltage is increased noticeably. It will be recognized that a continuing need exists for the development of anodes, materials and structures whereby the use of noble metals or noble metal oxides may be substantially minimized or eliminated.

Accordingly, it is an object of the present invention to provide improved electrodes for use as anodes in the electrolysis of aqueous solutions of ionizable chemical compounds, especially brines. It is a further object to provide such anodes wherein the amount of noble metal or noble metal oxide employed is substantially minimized or eliminated. It is a still further object to provide such anodes having an operative surface of noble metal or noble metal oxide and having improved efficiency and maintenance characteristics. It is an additional object to provide an improved method for the electrolysis of aqueous solutions of ionizable chemical compounds, especially brines.

STATEMENT OF INVENTION

This invention provides a novel electrode, especially suited for use as an anode in the electrolysis of aqueous solutions of ionizable chemical compounds such as brines; the novel electrode comprising an electroconductive substrate having a coating thereon of an electroconductive tin oxide containing a doping amount of niobium, preferably about 0.1 to about 15 mole percent of niobium, based on the moles of tin. The electrode may be employed, for example, as an anode in chlor-alkali cells or alkali metal chlorate cells. Alternatively, in a preferred embodiment the electrocatalytic properties of the electrode may be enhanced by the addition of a relatively small amount of an additional electrocatalytic material, such as a noble metal or noble metal oxide, either as a component of the conductive tin oxide coating or as an outer coating on the surface thereof. Electrodes of this type exhibit a high degree of durability in addition to the relatively low overvoltage characteristics of a noble metal or noble metal oxide, making them well-suited for use as anodes in electrolytic cells.

The advantages which accrue from the incorporation of an additional electrocatalytic component a noble metal oxide as a component of the niobium-doped tin oxide coating are several. The relatively low overvoltage characteristics of the noble metal oxide are exhibited while the amount of expensive noble metal oxide employed is minimized. In addition, the loss of noble metal oxide as a result of normal use and wear may be minimized since the noble metal oxide is bound in a matrix of tin oxide. In such coatings it is preferred to employ a relatively small amount of noble metal oxide, such as up to about 20 mole percent and preferably about 0.1 to about 10 mole percent of noble metal based on moles of tin.

In another alternative embodiment the additional electrocatalytic material, such as noble metal or noble metal oxide, may be applied as an outer layer or coating on the surface of the niobium doped tin oxide coating. Among the advantages of such construction is the protection afforded the metal substrate by the coating of conductive tin oxide. The preferred substrate materials of the anodes of the invention are the valve metals, such as titanium, tantalum, niobium or zirconium. However, where suitably thick intermediate layers of niobium-doped tin oxide are employed, other less expensive and/or more conductive materials may be employed as substrates. The niobium-doped tin oxide coating, which may range in coating weight for example, from about 0.1 grams per square meter to 100 grams per square meter or more, depending on the degree of protection desired, prevents contact of the substrate and the electrolyte, thus preventing or delaying a corrosion or surface oxidation and the attendant deterioration or passivation of the substrate. At the same time, the outer layer provides the advantageous catalytic properties of the noble metals or noble metal oxides. In addition, the protective layer of conductive tin oxide permits the use of a relatively thin layer of the noble metal or noble metal oxide and a consequent savings resulting from a minimal use of the precious metal. Typically, the layer of noble metal or noble metal oxide will have a coating weight in the range of about 0.1 grams per square meter to about 20 grams per square meter or higher and preferably about 3 to 10 grams per square meter in thickness. The disadvantage of pores or pinholes in the noble metal layer common in extremely thin layers is obviated by the presence of the intermediate layer of conductive tin oxide. Pores or pinholes in the noble metal layer, or wearing away of that outer layer over long periods of use result in the gradual exposure of the tin oxide layer. The intermediate layer of doped tin oxide which may contain a minor proportion of an additional electrocatalytic component will continue to provide a catalytically active surface in those exposed areas. In addition, the intermediate layer will tend to protect the substrate from anodic oxidation which causes loss of conductivity and can lead to problems of adherence. Thus, the overall deterioration of the catalytic properties of the anode is more gradual and maintenance problems are accordingly lessened.

In addition, where thinner coatings of noble metal oxide are employed the intermediate layer of tin oxide provides increased epitaxy and this may be expected to provide an increase in surface area of the anode with a consequent improvement in overvoltage. Furthermore, the adhesion of the noble metal or noble metal oxide to the substrate may be increased by the presence of the intermediate layer of tin oxide and the problem of spalling of the surface layer thereby reduced.

The electroconductive substrate which forms the inner or base component of the electrode, may be selected from a variety of electroconductive materials, such as graphite or metal, having sufficient mechanical strength to serve as a support for the coating. It is preferred to employ an electroconductive material having a high degree of resistance to chemical attack in anodic environment of electrolytic cells, such as a valve metal. Typical valve metals include, for example, Ti, Ta, Nb, Zr, and alloys thereof. The valve metals are well known for their tendency to form an inert oxide film upon exposure to an anodic environment. The preferred valve metal, based on cost and availability as well as electrical and chemical properties is titanium. The conductivity of the valve metal substrate may be improved, if desired, by providing a central core of a highly conductive metal such as copper. In such an arrangement, the core must be electrically connected to and completely protected by the valve metal substrate.

Conductive coatings of tin oxide containing a minor proportion of niobium may be adherently formed on the surface of the valve metal substrate by various methods known in the art to provide a protective, electrocatalytic, electroconductive layer which is especially resistant to chemical attack in anodic environments. Typically such coatings may be formed by first chemically cleaning the substrate, for example, by degreasing and etching the surface in a suitable acid, e.g., oxalic acid, then applying a solution of appropriate thermally decomposable salts, drying and heating in an oxidizing atmosphere. The salts that may be employed include, a wide variety of thermally decomposable inorganic or organic salts or esters of tin and niobium including for example their chlorides, oxychlorides, alkoxides, alkoxy halides, resinates, amines and the like. Typical salts include for example, stannic chloride, stannous chloride, dibutyltin dichloride, tin tetraethoxide, niobium chloride, niobium oxychloride and the like. Suitable solvents include for example, ethyl alcohol, propyl alcohol, butyl alcohol, pentyl alcohol, amyl alcohol, toluene, benzene and other organic solvents as well as water.

The solution of thermally decomposable salts, containing for example, a salt of tin and a salt of niobium in the desired proportions, may be applied to the cleaned surface of the valve metal substrate by painting, wiping, brushing, dipping, rolling, spraying or other method. The coating is then dried by heating for example at about 100° to 200° C for several minutes to evaporate the solvent, and then heating at a higher temperature, e.g., 250° to 800°C in an oxidizing atmosphere to convert the tin and niobium compounds to the oxide form. The procedure may be repeated as many times as necessary to achieve a desired coating weight or thickness. The final coating weight of this conductive tin oxide coating may vary considerably, but is preferably in the range of about 3 to about 30 grams per square meter. Although the exact form in which the niobium is present in the final oxide coating is not certain, it is assumed to be present as a replacement for tin in a tin dioxide lattice structure.

If desired, a minor proportion of an additional electrocatalytic material such as a compound of manganese, cobalt, nickel, iron or noble metal may be incorporated in the niobium-tin oxide coating. In such an embodiment, it is preferred to employ a relatively small amount such as up to about 20 mole percent and preferably about 0.1 to about 10 mole percent of electrocatalytic compound or element based on moles of tin. The noble metal oxide, such as an oxide of platinum, iridium, rhodium, palladium, ruthenium or osmium or mixtures thereof may be incorporated in the niobium-tin oxide coating by including in the above-described solution of thermally decomposable salts, an appropriate amount of a thermally decomposable salt of the noble metal, such as a noble metal halide.

In addition, an outer coating of a noble metal or noble metal oxide, such as platinum, iridium, rhodium, palladium, ruthenium or osmium metal or oxide or alloy or mixtures of these, may be applied to the surface of the conductive tin oxide. An outer coating of a noble metal may be applied by known methods such as electroplating, chemical deposition from a platinum coating solution, spraying, or other methods.

Preferably, the outer coating of the anode comprises a noble metal oxide. Noble metal oxide coating may be applied by first depositing the noble metal in the metallic state and then oxidizing the noble metal coating, for example, by galvanic oxidation or chemical oxidation by means of an oxidant such as an oxidizing salt melt, or by heating to an elevated temperature, e.g., 300° to 600°C or higher in an oxidizing atmosphere such as air oxygen, at atmospheric or superatmospheric pressures to convert the noble metal coating to a coating of the corresponding noble metal oxide. Other suitable methods include, for example, electrophoretic deposition of the noble metal oxide; or application of a dispersion of the noble metal oxide in a carrier, such as alcohol, by spraying, brushing, rolling, dipping, painting, or other method on to the tin oxide surface followed by heating at an elevated temperature to evaporate the carrier and sinter the oxide coating. A preferred method for the formation of the noble metal oxide coating involves coating the conductive tin oxide surface with a solution of a noble metal compound, evaporating the solvent and converting the coating of noble metal compound to the oxide by chemical or electrochemical reaction. For example, the conductive tin oxide surface may be coated with a solution of a thermally decomposable salt of a noble metal, such as a solution of a noble metal halide in an alcohol, evaporation of the solvent, followed by heating at an elevated temperature such as between about 300° and 800°C in an oxidizing atmosphere such as air or oxygen for a period of time to convert the noble metal halide to a noble metal oxide. The procedure for formation of a noble metal or noble metal oxide coating may be repeated as often as necessary to achieve the desired thickness. The foregoing and other methods for the preparation of coatings of noble metals and noble metal oxides on the surface of anodes for use in electrolytic cells are well known in the art and may be found for example in U.S. Pat. Nos. 2,719,797 and 3,711,385.

The following specific examples will serve to further illustrate this invention. In the examples and elsewhere in this specification and claims, all temperatures are in degrees Celsius and all parts are by weight unless otherwise indicated.

EXAMPLE I

A. A strip of titanium plate was prepared by immersion in hot oxalic acid for several hours to etch the surface, then washed and dried. A solution of about 0.40 parts of $NbCl_5$ and 3.43 parts of $SnCl_4.5H_2O$ in a mixture of 2 parts of methanol and 4 parts of isopropanol was wiped on to the titanium surface at room temperature. The coating was dried at about 200°C for 2 minutes then heated in an oven with a forced flow of air at about 450°C for 1 minute. The coating and heating process was repeated several times to build up the coating weight. Following the final coating the plate was heated with a forced flow of air at about 450°C for about 2 minutes.

The niobium-tin oxide coated titanium plate was further coated in the following manner:

B. An aqueous solution of 5 percent by weight of $RuCl_3.3H_2O$ was painted on the niobium-tin oxide surface at room temperature. The coating was fired in air at 200°C for 2 minutes then heated in an oven with a forced flow of air at 450°C for 3 minutes. The coating and heating steps were repeated 4 times to build up the coating and finally heated in an oven with a forced flow of air at 450°C for 15 minutes.

The anode thus prepared consisted of a titanium substrate having an intermediate coating thereon of niobium doped tin oxide, and an outer coating of ruthenium oxide.

In polarization measurements in 5 molar sodium chloride solution (pH of about 4.0) at a temperature of 95°C, the anode exhibited an activation overpotential for chlorine evolution of 60 millivolts at a current density of 200 milliamperes per square centimeter.

C. For purposes of comparision an anode was prepared in a similar manner except that no intermediate coating was employed. The anode was prepared by immersing a strip of titanium plate in hot oxalic acid for several hours to etch the surface, then washing and drying and applying a ruthenium dioxide coating directly thereon in the manner of Example 1B.

The anode of Examples 1B and 1C exhibited similar overpotential values at higher current densities. At a current density of 500 ma/cm$^2$ in 5 molar NcCl at 95°C, both anodes exhibited an overpotential of 70 millivolts. At lower current densities, that is below about 200 ma/cm$^2$, the anode of Example 1B exhibited a slightly lower overpotential than did the anode of Example 1C. At 50 ma/cm$^2$ the anode of Example 1B exhibited an overpotential 40 millivolts while the anode of Example 1C exhibited an overpotential of 50 millivolts.

EXAMPLE 2

A. A titanium coupon was prepared by immersion in oxalic acid at 95°C for 2 hours to etch the surface, then washed and dried. A solution of 0.26 parts of $NbCl_5$, 3.02 parts of $SnCl_4.5H_2O$ and 0.13 parts of $RuCl_3$ in 1.0 parts of methanol and 2.0 parts of isopropanol was sprayed on to the titanium surface and dried at 100°C for 2 minutes, then heated in a forced flow of air at 500°C for 2 minutes. A total of four coats was thus applied to increase the coating weight. Following the drying of the final coating, the coated titanium was heated in a forced flow of air at 500°C for a period of 5 minutes. The final coating weight of niobium doped tin oxide containing ruthenium oxide was 0.28 milligrams per square centimeter.

B. The coated titanium coupon was then further coated with an outer coating of $RuO_2$ in the following manner:

An aqueous solution of 5 percent by weight of $RuCl_3.3H_2O$ was painted on the surface and dried in air at 200°C for 2 minutes, then heated in a forced flow of air at 500°C for 5 minutes. A total of 5 coats were thus applied with a final heating in a forced flow of air at 500°C for 15 minutes. To yield an outer coating of $RuO_2$ having a coating weight of 0.90 milligrams per square centimeter.

C. Polarization measurements of the anode of Example 1A and Example 1B were made in a 5 molar NaCl solution (pH = 4) at a temperature of 95°C. At a current density of 200 ma/cm$^2$ the activation overpotential for chlorine evolution was 105 millivolts for the anode of Example 2A and 72 millivolts for the anode of Example 2B. The measurements were taken over about a 3 hour test period, during which the overpotential of each anode remained substantially constant.

What is claimed is:

1. An electrode comprising an electroconductive substrate and a coating thereon of tin oxide containing as a doping agent niobium in the amount of about 0.1 to about 15 mole percent based on the moles of tin and having an electrocatalytic material present at the outer surface of said coating.

2. An electrode according to claim 1 wherein the substrate is a valve metal.

3. An electrode according to claim 2 wherein the substrate is titanium.

4. An electrode according to claim 3 containing as a component of said coating up to about 20 mole percent of a noble metal oxide, based on the moles of tin.

5. An electrode according to claim 4 wherein said noble metal oxide is ruthenium oxide.

6. An electrode according to claim 5 wherein the ruthenium oxide is present in said coating in an amount of about 0.1 to about 10 mole percent, based on the moles of tin.

7. An electrode according to claim 1 comprising an electroconductive substrate, a coating thereon of tin oxide containing about 0.1 to about 15 mole percent of niobium, based on the moles of tin, and an outer coating of a noble metal or noble metal oxide.

8. An electrode according to claim 7 wherein the outer coating is a noble metal oxide.

9. An electrode according to claim 8 wherein the outer coating is ruthenium oxide.

10. An electrode according to claim 9 wherein the substrate is a valve metal.

11. An electrode according to claim 10 wherein the substrate is titanium.

12. An electrode according to claim 1 comprising an electroconductive substrate, a coating thereon of tin oxide containing about 0.1 to about 15 mole percent of niobium and up to about 20 mole percent of a noble metal oxide, based on moles of tin, and an outer coating of a noble metal or noble metal oxide.

13. An electrode according to claim 12 wherein said outer coating is a noble metal oxide.

14. An electrode according to claim 13 wherein said outer coating is ruthenium oxide.

15. An electrode according to claim 14 wherein said coating of tin oxide contains about 0.1 to about 10 mole percent of ruthenium oxide based on moles of tin.

16. An electrode according to claim 15 wherein said substrate is a valve metal.

17. An electrode according to claim 16 wherein said substrate is titanium.

* * * * *